United States Patent [19]

Hansen

[11] 4,122,446

[45] Oct. 24, 1978

[54] DUAL MODE FEED HORN

[75] Inventor: Laurence H. Hansen, Oak Lawn, Ill.

[73] Assignee: Andrew Corporation, Orland Park, Ill.

[21] Appl. No.: 791,831

[22] Filed: Apr. 28, 1977

[51] Int. Cl.[2] ..... H01Q 13/02

[52] U.S. Cl. ..... 343/786; 333/21 R

[58] Field of Search ..... 343/786, 777, 778; 333/21 R

[56] References Cited

U.S. PATENT DOCUMENTS

| | | | |
|---|---|---|---|
| 3,413,641 | 11/1968 | Turrin | 343/786 |
| 3,413,642 | 11/1968 | Cook | 343/786 |
| 3,482,252 | 12/1969 | Nagelberg | 343/786 |
| 3,530,481 | 9/1970 | Tanaka et al. | 343/786 |

*Primary Examiner*—Eli Lieberman

*Attorney, Agent, or Firm*—Leydig, Voit, Osann, Mayer & Holt, Ltd.

[57] ABSTRACT

A dual-mode feed horn for microwave antennas includes a multi-step microwave transformer having a series of abrupt steps with progressively increasing radial dimensions. At least certain of the steps have dimensions sufficiently large to convert $TE_{11}$ mode energy passing therethrough to $TM_{11}$ mode energy. The transformer is preferably a binomial transformer, and the axial length of the transformer is preferably about equal to the number of steps therein multiplied by $\frac{1}{4}$ of the average wavelength of the microwave energy to be passed therethrough. A pair of waveguides are connected to opposite ends of the transformer for transmitting microwaves through the transformer, and the waveguide connected to the larger-diameter end of the transformer has an inside diameter at least as large as the maximum inside diameter of the transformer and a length sufficient to produce a predetermined phase relationship between the $TE_{11}$ mode energy and the $TM_{11}$ mode energy.

5 Claims, 8 Drawing Figures

H PLANE

E PLANE

H PLANE

E PLANE

DUAL MODE FEED HORN

DESCRIPTION OF THE INVENTION

The present invention relates generally to feed horns for microwave antennas and, more particularly, to dual mode feed horns for microwave antennas.

It is a primary object of the present invention to provide a dual mode microwave feed horn that is useful in communication systems.

Another object of the invention is to provide such a feedhorn that has a large pattern bandwidth with suppressed side lobes and substantially equal beamwidths in the E and H planes, and improved wide band low VSWR performance.

It is a further object of the invention to provide such an improved dual mode microwave feed horn which can be economically manufactured.

Other objects and advantages of the invention will be apparent from the following detailed description and the accompanying drawings, in which.

Figure 1:
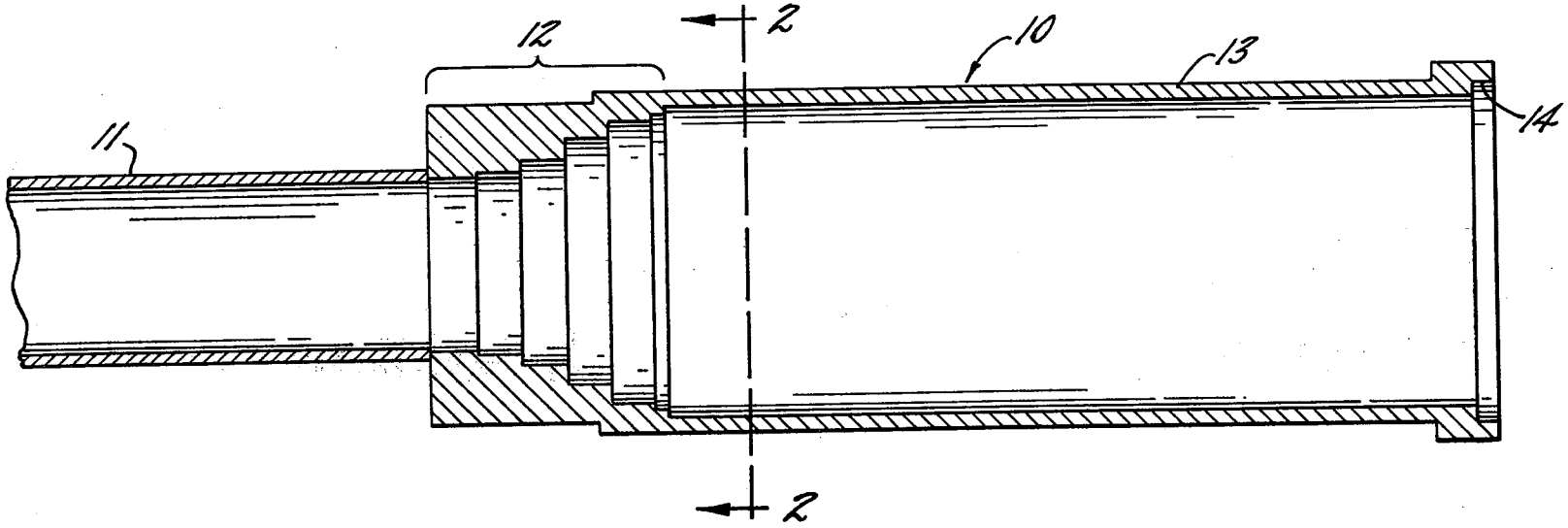
FIG. 1 is a longitudinal section of a microwave feed horn embodying the invention.
Figure 2:
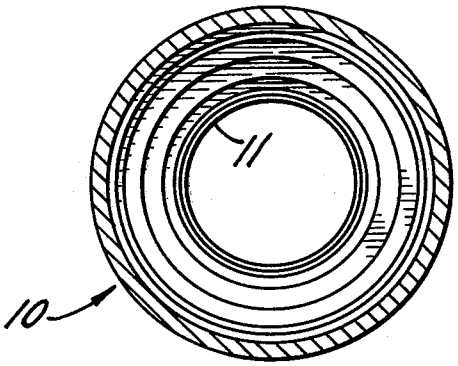
FIG. 2 is a section taken along line 2—2 in FIG. 1.
Figures 5A, 5B:
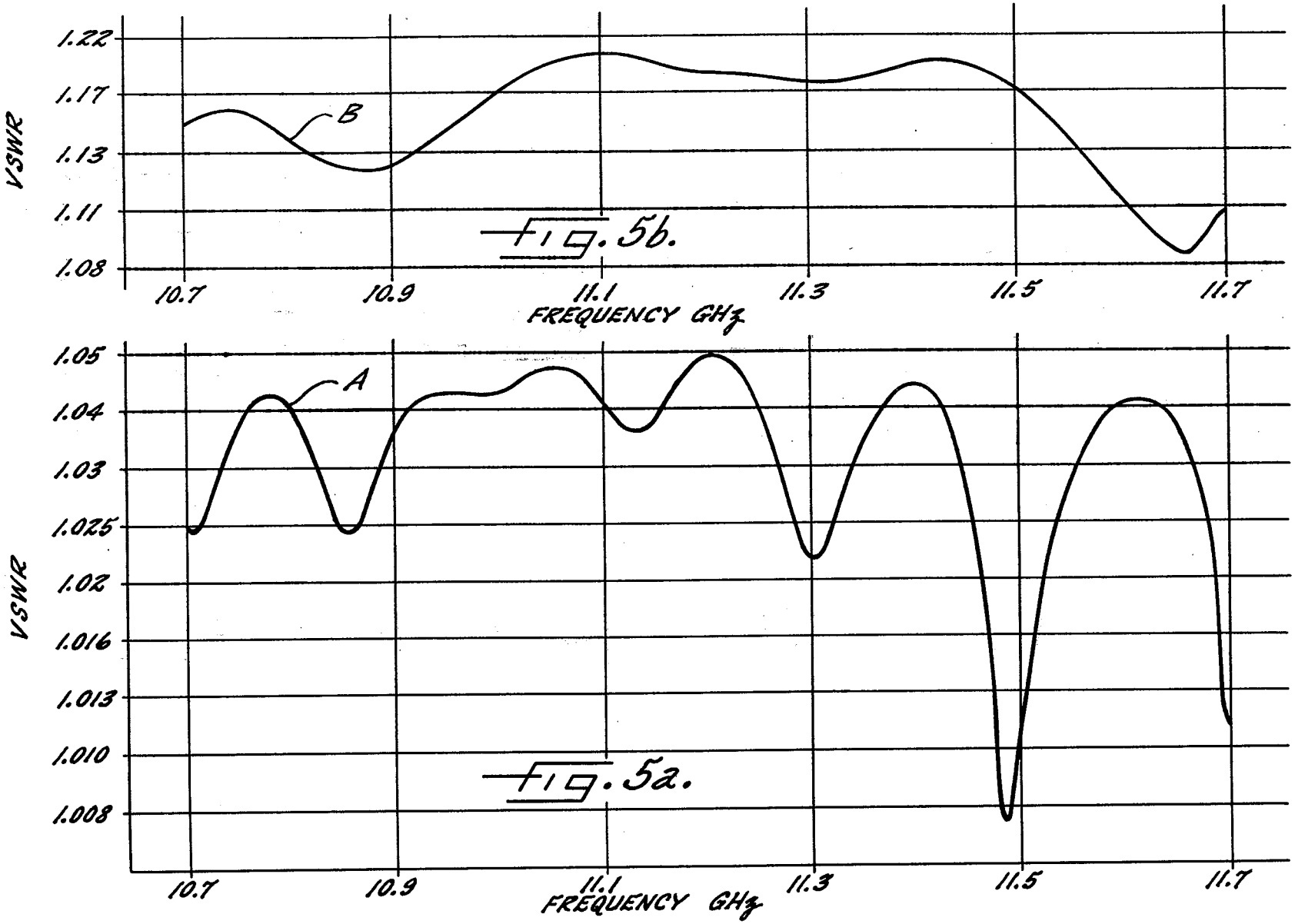
Figure 6:
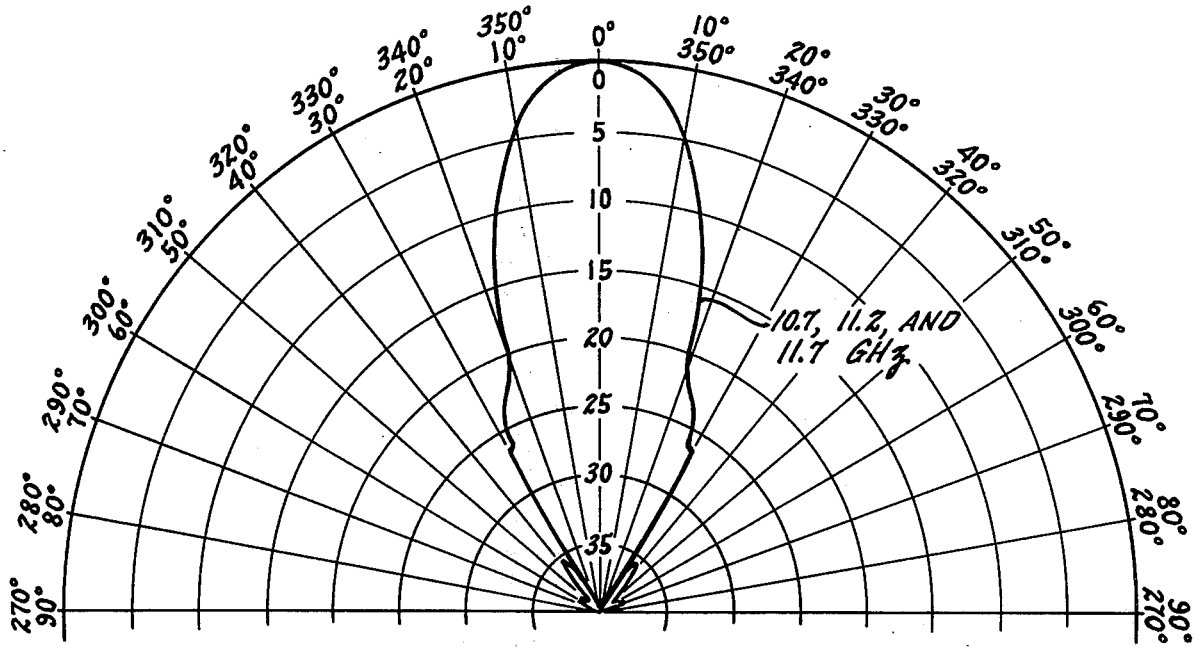
Figure 7:
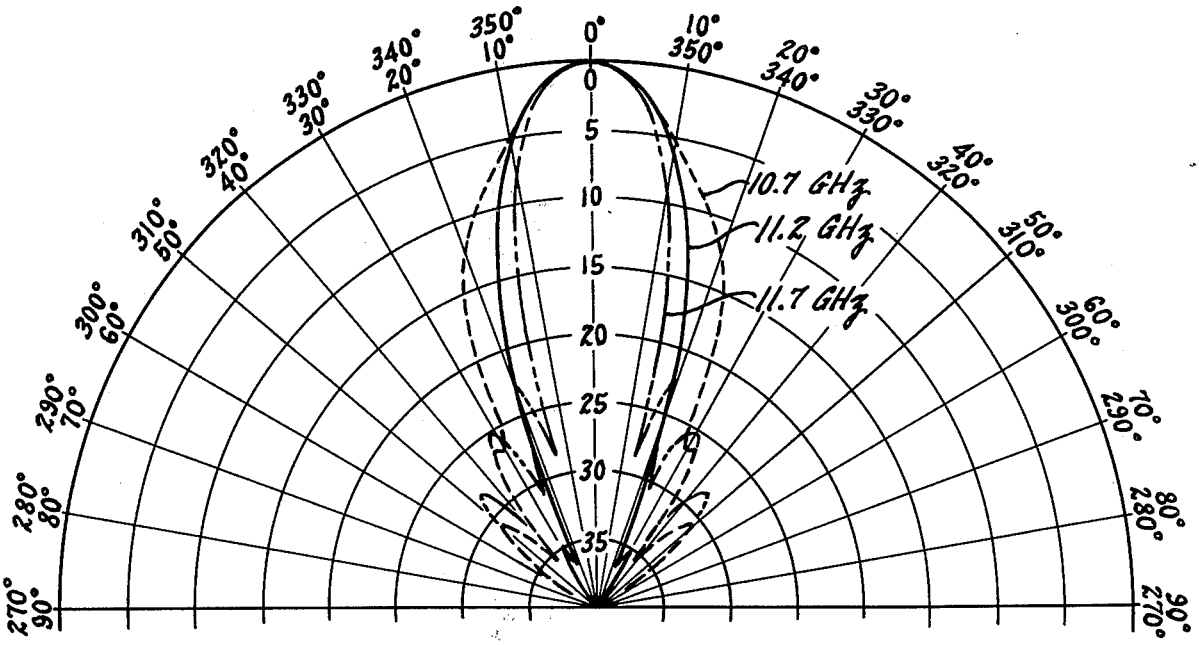

FIGS. 5*a* and 5*b* are a pair of VSWR curves, one obtained from the feed horn of FIGS. 1 and 2 and the other from a prior art horn;

FIG. 6 is an H-plane radiation pattern generated at different frequencies by the same prior art feed horn that produced the higher VSWR curve shown in FIG. 5; and FIG. 7 is a series of E-plane radiation patterns generated at different frequencies by the same prior art horn that produced the higher VSWR curve shown in FIG. 5.

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

Turning now to the drawings and referring first to FIG. 1, there is shown a feed horn 10 for receiving microwave energy from a circular waveguide 11 and feeding it to a parabolic antenna (not shown). As will be understood by those familiar with this art, the microwave energy in the waveguide 11 is typically propagated in the dominant $TE_{11}$ mode, but it is desirable to convert a portion of the energy to the higher order $TM_{11}$ mode in the feed horn 10 in order to produce a radiation pattern having suppressed side lobes and substantially equal beamwidths in the E and H planes.

In accordance with one important aspect of the present invention, the feed horn has a series of abrupt steps with progressively increasing radial dimensions with at least certain of the steps having dimensions sufficiently large to generate the $TM_{11}$ mode in microwaves passing therethrough. Thus, in the illustrative embodiment, the feed horn 10 has a stepped segment 12 for receiving microwaves from the waveguide 11 and transmitting them to an elongated cylindrical segment 13 which radiates the microwaves onto a reflective antenna, typically a parabolic antenna (not shown). The elongated cylindrical segment 13 is dimensioned to radiate the $TE_{11}$ and $TM_{11}$ modes in phase with each other. A final step 14 is formed at the aperture of the cylindrical segment 13 for the impedance matching of a conventional window on the horn. With this feed horn, not only is the $TM_{11}$ mode generated to produce a dual mode feed to the antenna, but also the wide band VSWR is minimized and the pattern bandwidth is maximized.

As described by P. D. Potter in his article "A New Horn Antenna With Suppressed Sidelobes And Equal Beamwidths," *The Microwave Journal,* June, 1963, pp. 71–78, and his related U.S. Pat. No. 3,305,870, an abrupt transition of appropriate dimension in the wall of a waveguide converts a portion of the dominant $TE_{11}$ mode energy to the higher order $TM_{11}$ mode. The amount of $TE_{11}$ mode energy that is converted to the $TM_{11}$ mode is dependent upon the magnitude of the abrupt transition, i.e., the amount of energy converted increases with increasing magnitudes of the transition. It is this conversion of a portion of the $TE_{11}$ mode to in-phase $TM_{11}$ mode energy that suppresses the side lobes and produces substantially equal beamwidths in the E and H planes.

In order to generate the $TM_{11}$ mode, at least one of the abrupt steps in the horn must have a diameter of at least 3.83 $\lambda/\pi$, where $\lambda$ is the wavelength of the microwave energy passing through the horn. Thus, when operating at a frequency of 11.7 GHz, for example, the $TM_{11}$ mode is first generated when one of the abrupt steps in the feed horn increases the inside diameter to at least 1.231 inches.

To provide improved wide band low VSWR performance, as compared to a single step horn, the feed horn includes a plurality of steps with a diameter large enough to generate the $TM_{11}$ mode so that successive increments of the dominant $TE_{11}$ mode energy are converted to the $TM_{11}$ mode along the length of the stepped segment 12 of the horn. To minimize the VSWR, the radial dimensions of the multiple steps are preferably dimensioned to form a binomial impedance transformer, i.e., the steps vary in diameter so as to vary the wave impedance according to the coefficients of the binomial equation.

The axial dimension of each step in the feed horn should be between $\frac{1}{8}$ and $\frac{3}{8}$ of the wavelength of the microwave energy passing therethrough, and the total length of the stepped portion of the horn should be about equal to the number of steps multiplied by $\frac{1}{4}$ of the average wavelength of the microwaves to be passed therethrough. The axial dimension of each step deviates physically from the theoretical $\frac{1}{4}$ wavelength in order to compensate for the field fringing that occurs at the junction between steps.

Steps with these dimensions minimize the reflection losses and VSWR. Additional information on the design of binomial transformers is found in Jasik, *Antenna Engineering Handbook,* pp. 31-12 and 31-13. While binomial transformers are preferred for use in this invention, other types of stepped transformers, such as Tchebyscheff, cosine, and exponential, may be used, and are well known to those skilled in the art.

In one working example of the illustrative feed horn adapted for connection to a circular waveguide having an inside diameter of 1.148inches, the successive steps in the inside wall of the stepped segment 12 of the horn have diameters of 1.159 inches, 1.219 inches, 1.387 inches, 1.678 inches, 1.932 inches, and 2.000 inches, and 0.312 inch, of 0.312 inches, 0.306 inch, 0.294 inch 0.284 inch, 0.278 inch, and 0.160 inch. The cylindrical section 13 has an inside diameter of 2.120 inches and a length of 4.672 with a step of 2.255 inches inside diameter and 0.264 inch, length at the end thereof for supporting a window.

To radiate a beam with suppressed side lobes and substantially equal beam widths in the E and H planes, the $TE_{11}$ and $TM_{11}$ modes must be in phase at the aperture of the horn. The phase difference $\Delta\lambda$ between the two modes at any distance from the plane of the step where the $TM_{11}$ mode is first generated is given by the formula:

$$\Delta\lambda = \frac{L}{\lambda_{g1}} - \frac{L}{\lambda_{g2}}$$

$$\lambda_g = \frac{\lambda_o}{\sqrt{1 - (\frac{\lambda_o}{\lambda_c})^2}}$$

where $\lambda_{g1}$ and $\lambda_{g2}$ are guided wavelengths inthe $TM_{11}$ and $TE_{11}$ modes, respectively. The formula for $\lambda_g$ in either mode is: where $\lambda_o = c/f$, c being the velocity of light and f the frequency in the middle of the operating band, $\lambda_c$ for $TE_{11}$ is 3.412a, $\lambda_c$ for $TM_{11}$ is 1.640a, a is the inside radius of the horn, and L is the axial length of each diameter. For the horn dimensions described above at a frequency of 10.7 GHz:

| L | 2a | $\lambda_{g1}$ | $\lambda_{g2}$ | $\Delta\lambda$ |
|---|---|---|---|---|
| 0.294" | 1.387" | 4.581" | 1.248" | 0.171λ |
| 0.284 | 1.678 | 1.849 | 1.196 | 0.084 |
| 0.278 | 1.932 | 1.539 | 1.171 | 0.057 |
| 0.160 | 2.000 | 1.493 | 1.167 | 0.030 |
| 4.672 | 2.120 | 1.429 | 1.159 | 0.761 |
| 0.264 | 2.255 | 1.376 | 1.152 | 0.037 |
| | | | | 1.140 |

Similar calculations for frequencies of 11.2 and 11.7 GHz yield $\Delta\lambda$'s of 1.113λ and 1.086 λ, respectively.

When the $TE_{11}$ and $TM_{11}$ modes are in phase, $\Delta\lambda$ is 1.00. If only the $TE_{11}$ mode energy were present, $\Delta\lambda$ would be 0, and if all the $TM_{11}$ mode energy were generated in any one step, the $\Delta\lambda$ for that step would be 1.0. Thus, the above calculations indicate that part of the $TM_{11}$ mode energy is generated in the 1.387-inch step and each succeeding step. This multi-step generation of the $TM_{11}$ mode is desirable to provide a bandwidth that is sufficiently large to permit the use of the feed horn in communication systems. In general, the bandwidth increases with the number of steps.

Figure 3:
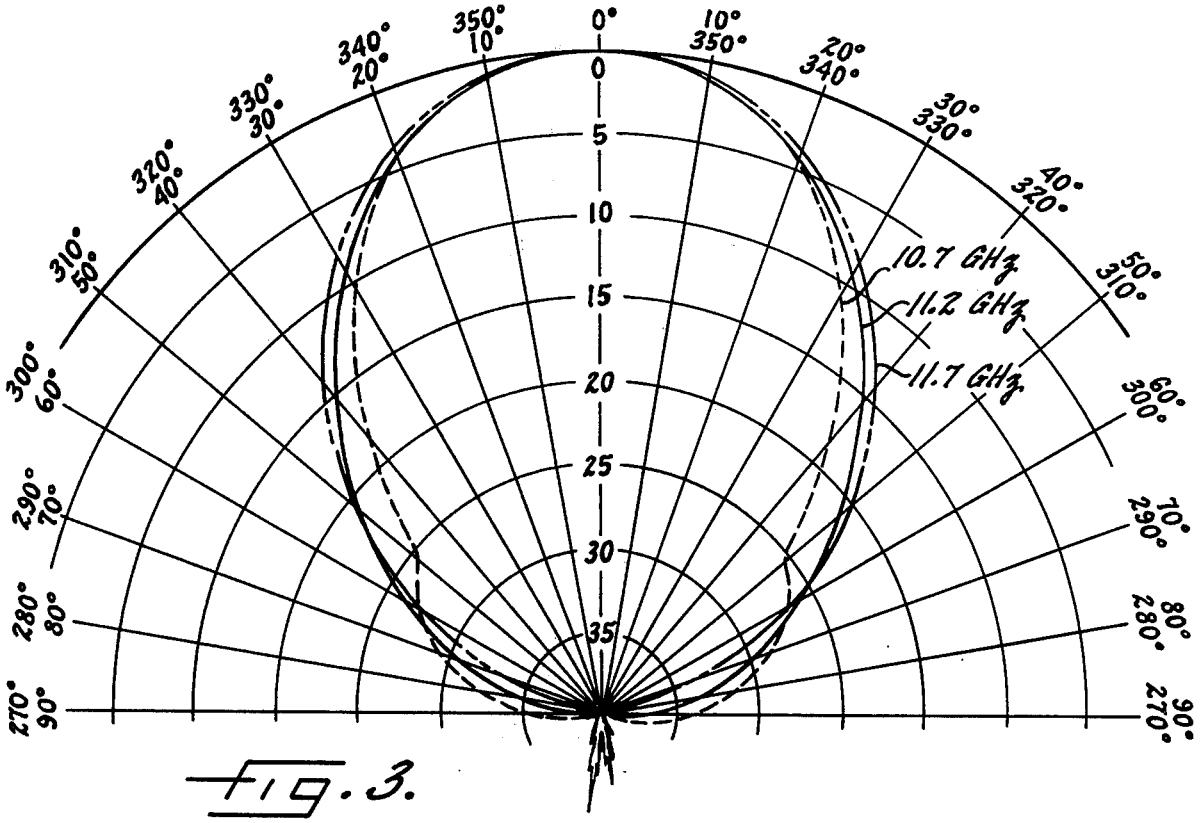
FIG. 3 is a series of H-plane radiation patterns generated by the feed horn of FIGS. 1 and 2 at different frequencies.
Figure 4:
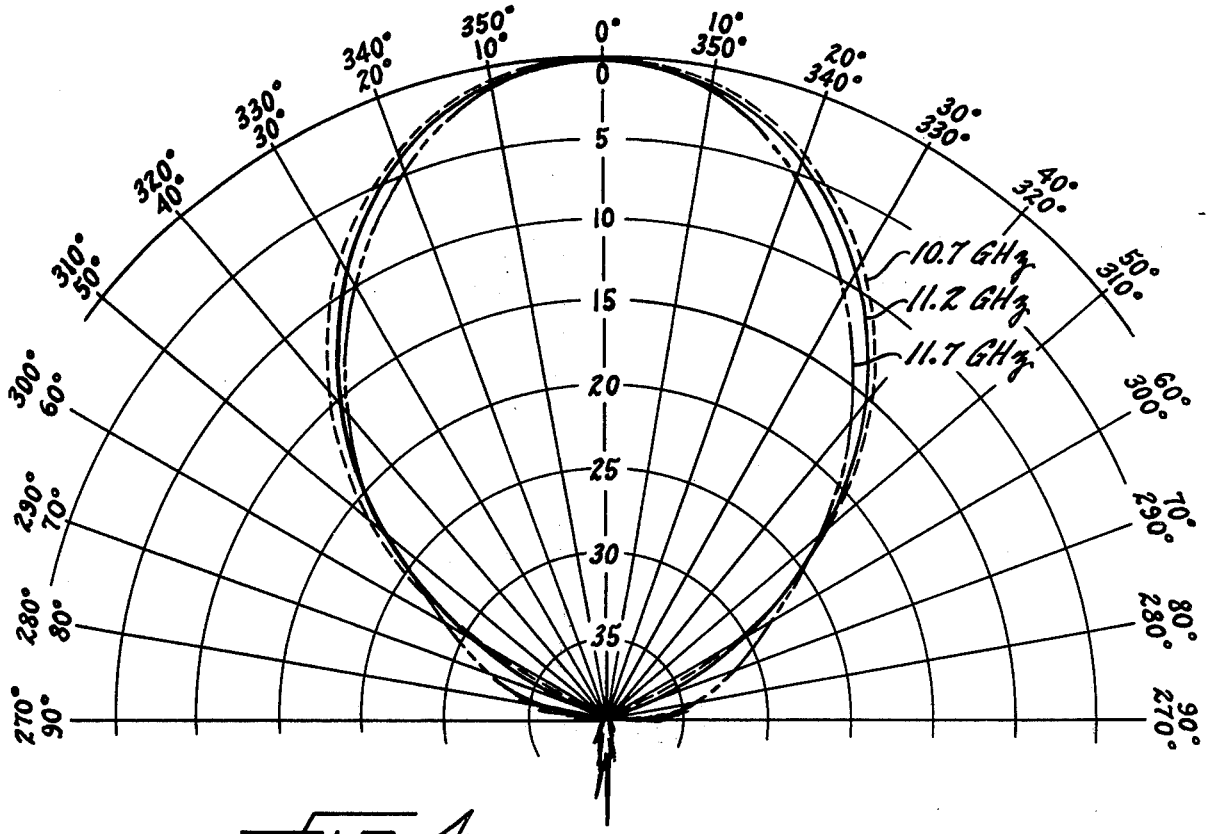
FIG. 4 is a series of E-plane radiation patterns generated by the feed horn of FIGS. 1 and 2 at different frequencies.

In FIGS. 3 and 4, there are shown actual radiation patterns obtained in the H and E planes, respectively, using the feed horn of FIGS. 1 and 2 with the dimensions described above at frequencies of 10.7, 11.2 and 11.7 GHz. It can be seen from these patterns that the horn had a large pattern bandwidth with substantially no side lobes, and substantially equal beamwidths were produced in the E and H planes, at all frequencies. FIG. 5 shows an impedance curve A for the same horn in terms of VSWR over the frequency range of 10.7 GHz to 11.7 GHz. It can be seen from this curve that the horn produces a low VSWR (less than 1.05 across the entire frequency range).

For purposes of comparison with the feedhorn described above, a single-step feedhorn of the type described in the above-cited Potter article was constructed and tested for radiation patterns and VSWR over the same frequency range of 10.7 GHz to 11.7 GHz. The radiation patterns generated by this horn in the H and E planes are shown in FIGS. 6 and 7, respectively, and the VSWR curve is shown as curve B in FIG. 5. It can be seen that this single-step horn had a substantially higher VSWR than the multi-step horn over the entire frequency range. Also, the patterns produced by the single-step horn included significant side lobes in the E plane at the upper and lower ends of the frequency range, thereby indicating a narrow pattern bandwidth in the E plane.

I claim as my invention:

1. A dual-mode feed horn for microwave antennas, said horn comprising a multi-step microwave transformer having a series of at least three serially connected abrupt steps with progressively increasing radial dimensions, said transformer being selected from the group consisting of binomial transformers, Tchebyscheff transformers, cosine transformers, and exponential transformers, a plurality of said steps having dimensions sufficiently large to convert $TE_{11}$ mode energy passing therethrough to $TM_{11}$ mode energy, and a pair of waveguides connected to opposite ends of said transformer for transmitting microwaves through said transformer, the waveguide connected to the larger-diameter end of said transformer having an inside diameter at least as large as the maximum inside diameter of said transformer and a length sufficient to produce a predetermined phase relationship between the $TE_{11}$ mode energy and the $TM_{11}$ mode energy.

2. A dual-mode feed horn as set forth in claim 1 wherein at least certain of said steps have a diameter of at least 3.83 $\lambda/\pi$ where λ is the wavelength of the microwave energy passing through the feed horn.

3. A dual-mode feed horn as set forth in claim 1 wherein the axial length of said transformer is about equal to the number of steps therein multiplied by ¼ of the average wavelength of the microwave energy to be passed therethrough.

4. A dual-mode feed horn as set forth in claim 3 wherein the axial length of each step in said transformer is between about ⅛ and ⅜ of the wavelength of the microwave energy to be passed through that step.

5. A dual mode feed horn as set forth in claim 1 wherein the waveguide connected to the larger diameter end of said transformer is of such length as to produce in-phase radiation of the $TE_{11}$ and $TM_{11}$ modes at its radiating aperture.

* * * * *